US005135319A

United States Patent [19]

Kobayashi et al.

[11] Patent Number: 5,135,319

[45] Date of Patent: Aug. 4, 1992

[54] INK RIBBON CASSETTE FOR USE IN A THERMAL TRANSFER PRINTER AND HAVING TENSION MEANS AND SYMMETRICALLY LOCATED GUIDE ROLLERS

[75] Inventors: Ryoichi Kobayashi; Masafumi Suzaki; Fumio Takahagi; Tomoji Kitagishi, all of Hitachi; Shigetaka Furukawa, Takahagi, all of Japan

[73] Assignee: Hitachi, Ltd., Tokyo, Japan

[21] Appl. No.: 405,024

[22] Filed: Sep. 11, 1989

Related U.S. Application Data

[63] Continuation of Ser. No. 147,725, Jan. 25, 1988, abandoned.

[30] Foreign Application Priority Data

Jan. 28, 1987 [JP] Japan ..... 62-16112

[51] Int. Cl.[5] ..... B41J 35/08

[52] U.S. Cl. ..... 400/208; 400/217; 400/234

[58] Field of Search ..... 400/120, 207, 208, 208.1, 400/217, 234, 240, 240.3, 240.4, 248

[56] References Cited

U.S. PATENT DOCUMENTS

| | | | |
|---|---|---|---|
| 3,409,113 | 11/1968 | McLean | 400/234 X |
| 4,013,160 | 3/1977 | Colecchi et al. | 400/234 X |
| 4,058,197 | 11/1977 | West | 400/234 X |
| 4,350,454 | 9/1982 | Schoenlein | 400/234 |
| 4,408,913 | 10/1983 | Frechette | 400/208 |
| 4,468,139 | 8/1984 | Hattori | 400/234 X |
| 4,496,255 | 1/1985 | Meintrup et al. | 400/208 |
| 4,528,572 | 7/1985 | Sasaki et al. | 400/208 X |
| 4,568,210 | 2/1986 | Privitera | 400/208 X |
| 4,620,199 | 10/1986 | Tatsumi et al. | 400/240.3 X |
| 4,629,346 | 12/1986 | Surti | 400/208 |
| 4,685,817 | 8/1987 | Surti | 400/208 |
| 4,718,783 | 1/1988 | Tsushima et al. | 400/208 X |

FOREIGN PATENT DOCUMENTS

| | | | |
|---|---|---|---|
| 0194694 | 9/1986 | European Pat. Off. | 400/234 |
| 2542259 | 12/1976 | Fed. Rep. of Germany | 400/234 |
| 2925618 | 1/1981 | Fed. Rep. of Germany | 400/234 |
| 3041055 | 6/1982 | Fed. Rep. of Germany | 400/234 |
| 2504858 | 11/1982 | France | 400/208 |
| 0047685 | 3/1982 | Japan | 400/208 |
| 0194042 | 12/1983 | Japan | 400/120 |
| 0015188 | 1/1985 | Japan | 400/208 |
| 0018373 | 1/1985 | Japan | 400/234 |
| 0148083 | 7/1986 | Japan | 400/234 |
| 0188176 | 8/1986 | Japan | 400/208 |

OTHER PUBLICATIONS

IBM Technical Disclosure Bulletin, "Supply Spool Tensioning", Cahill, vol. 25, No. 8, Jan. 1983, pp. 4058–4059.

*Primary Examiner*—Edgar S. Burr
*Assistant Examiner*—John S. Hilten
*Attorney, Agent, or Firm*—Antonelli, Terry, Stout & Kraus

[57] ABSTRACT

Guide rollers are provided to be symmetric with respect to a center of the thermal head. The guide rollers comprise first two guide rollers provided in a vicinity of the thermal head, a guide roller provided in a vicinity of the supply core, a guide roller provided in a vicinity of the take-up core, and second two guide rollers. The second two guide rollers are disposed nearly in a vicinity of the first two guide rollers. The back tension force adding members comprise a fixed brake adding member provided at the supply shaft and an outer peripheral brake adding member for contacting the ink ribbon. The ink ribbon shifting down phenomenon can be prevented. The dirty background and the rubbing transfer phenomenon can be reduced. The aligned winding of the ink ribbon make possible a practical reciprocating ink ribbon cassette. without concern about ink ribbon winding accidents.

6 Claims, 5 Drawing Sheets

INK RIBBON CASSETTE FOR USE IN A THERMAL TRANSFER PRINTER AND HAVING TENSION MEANS AND SYMMETRICALLY LOCATED GUIDE ROLLERS

This is a continuation of application Ser. No. 147,725, filed Jan. 25, 1988, now abandoned.

BACKGROUND OF THE INVENTION

The present invention relates to an ink ribbon cassette for use in a thermal transfer printer, and more particularly to an ink ribbon cassette for use in a thermal transfer printer suitable for an aligned winding of an ink ribbon in the ink ribbon cassette to maintain the stability of tension force in the ink ribbon of a reciprocating ink ribbon cassette.

A disadvantage of an ink ribbon in the ink ribbon cassette used in a conventional thermal transfer printer resides in the fact that, because an ink of the ink ribbon in the ink ribbon cassette is completely transferred to a thermal transfer printing paper in only one printing operation and cannot be reused, the ink ribbon increases the overall operational costs of the thermal transfer printer.

To avoid the above described disadvantage, a thermal transfer printer was proposed in Japanese Utility Model Laid-Open No. 194042/1983, wherein the thermal transfer printer has a reversing mechanism for reversing a driving direction of an ink ribbon and also a vertical movement mechanism for a thermal head whereby it is possible to print in both the forward direction and the backward direction with two rows, that is, an upper row and a lower row of the ink ribbon in the ink ribbon cassette. However, this thermal transfer printer is structurally complex because both a reversing mechanism for the ink ribbon and a vertical movement mechanism for the thermal head are necessary.

Furthermore, for the thermal transfer printer to reciprocatingly print the moving distances of the ink ribbon to go in a forward direction and return in a backward direction must be equal, and hence the ink ribbon cannot stop moving and printing in the same line of the ink ribbon. This is not economical in terms of the consumption of the ink ribbon in the ink ribbon cassette.

When printing in the thermal transfer printer is carried out in a pair of upper and lower rows of the ink ribbon only by reversing the ink ribbon cassette without both the reversing mechanism in a driving direction of the ink ribbon and the vertical movement mechanism of the thermal head in the thermal transfer printer itself, the thermal transfer printer can unidirectionally print.

The effective length of used ink ribbon received in the ink ribbon cassette in such a thermal transfer printer can be twice that of previous ones, so that a lower operational cost can be realized by the user of the thermal transfer printer.

However, there are technically difficult problems in the printing operation for the thermal transfer printer having the ink ribbon in plural rows such as two upper and lower rows using the same ink ribbon.

These problems are caused by factors such as a "partial printing" phenomenon in which wrinkles are caused by the ink ribbon shifting down during the winding start of the ink ribbon in which a large tension force ratio exists, a "background dirty" phenomenon in which tail dragging is caused by the reversal between the winding force tension ($T_o$) and the back tension force ($T_i$) (the brake force against the taking up force) just before completion of printing and further a reverse rotation brake torque of the winding take-up shaft which occurs after one line printing of the thermal head, and a head touch smudge caused by slack ink ribbon, etc.

The tension force ratio ($T_o/T_i$) is a ratio of a winding tension force ($T_o$) to a compound brake force ($T_i$). The compound brake force ($T_i$) is an outer peripheral brake force and a friction resistance force of a supply shaft, in which an ink ribbon supply core is engaged with, namely, a brake force by a constant brake torque.

As stated above, when printing by the thermal transfer printer is carried out in a pair of upper and lower rows of the ink ribbon only by the reverse mechanism of the ink ribbon cassette without both the reversing mechanism in the driving direction of the ink ribbon and the vertical movement mechanism of the thermal head in the thermal transfer printer itself, the thermal transfer printer can utilize a unidirectional printing method, and further the effective length of used ink ribbon in the thermal transfer printer can be twice that of previous ones.

However, the ink ribbon fold, the printing rub, and the partial printing etc., which are caused respectively by the "ink ribbon shifting down" phenomenon of the ink ribbon become serious problems. In particular, the ink ribbon fold, which is caused by the overlapping portion of the ink ribbon in a special pattern, such as a mesh pattern, by the "ink ribbon shifting down" phenomenon happens often and becomes a serious problem of utmost importance. We have experimentally ascertained that this ink ribbon fold phenomenon does not occur when the back tension force is increased.

However, when the back tension force increases, the tension force ratio relationship is reversed rapidly before the printing operation is complete, as a result of which the "background dirty" phenomenon such as tail dragging starts to occur. As a way of suppressing the "ink ribbon shifting down" phenomenon, it has been proposed to provide a felt member on a plate spring member, which is disposed in the vicinity of the thermal head so that the ink ribbon is pressed down at the vicinity of the thermal head.

However, experimentation has determined that, even if the ink ribbon is merely pressed down, the "ink ribbon fold" phenomenon caused by the "ink ribbon shifting down" phenomenon is not prevented. Such an "ink ribbon shifting down" phenomenon is caused by the imbalance of the ink ribbon tension force. The tension force runs from the take up side to the supply side through the ink ribbon which is one having no attached portion with the glaze portion of the thermal head.

With only the fixed or constant back tension force, the distance from the fixed or constant back tension force portion to the winding outer peripheral portion of the supply ink ribbon is too long, and an additional ink ribbon tension force imbalance caused by the slack is created. The looseness of the supply core and the inclination of the supply core also add to the imbalance.

The "ink ribbon shifting down" phenomenon can be prevented to a certain extent by adding a fixed or constant brake force with the supply core portion. In other words, a felt-like seat brake member for adding brake force to the take-up core or supply core or a spring member mounted on the ink ribbon outer peripheral portion for pressing the ink ribbon with the adhesion member having a felt friction member as a felt member can be provided. Taking account of the scattering of the take up shaft torque or the scattering of the ink ribbon back tension force, it is necessary to enlarge still more the use range of the ink ribbon tension force ratio.

Therefore, with only the above stated three countermeasures against the prevention of the "ink ribbon shifting down" phenomenon, the ink ribbon tension force ratio cannot be maintained constant over the whole printing range. Further, the felt-like seat brake structure is made up to sandwich the felt member in the clearance between the ink ribbon cassette interior upper and lower surfaces and the supply core, so that large scattering of the ink ribbon back tension force exists, and the ink ribbon back tension force becomes further unstable.

Herein, generation of the wrinkles, which occurs by the "ink ribbon shifting down" phenomenon, will be explained. As compared with the thermal transfer printer in which the central part of the ink ribbon is used for printing, when the thermal transfer printer prints in plural rows, such as the upper and lower two rows, the center of the ink ribbon is not at the printing center of the ink ribbon. As a result, the stress distribution acting on the ink ribbon during ink ribbon travel differs from the upper row of the ink ribbon to the lower row of the ink ribbon.

At the ink ribbon upper row printing, the ink ribbon is shifted down at the thermal head portion to the lower direction, thereby the ink ribbon wrinkles occur. This phenomenon occurs easily in a mesh pattern during the return passage printing process, when the ink ribbon back tension force is smaller or the taking up tension force is excessive. The reasons will be explained as follows.

The thickness of the ink ribbon is very thin, such as about 6–7 μm. When stress occurs in the interior portion of the ink ribbon, the longitudinal force becomes the predominant one. The ribbon thickness at the ink used up portion or the ink omitted portion is reduced to about 3 μm thickness by the omission of the ink. When the ink ribbon tension force is applied at the ink used up portion, ink ribbon local elongation at the ink used up portion occurs by virtue of the heating of the thermal head. As a result, the ink used up portion of the ink ribbon is expanded and absorbs the inner strain of the ink ribbon.

Due to localized decrease of the elongation rigidity by the expansion of the ink ribbon and the thickness reduction in the ink ribbon, ink ribbon tension force cannot be exerted at the ink used up portion of the ink ribbon. Consequently the ink ribbon tension force distribution in the width direction of the ink ribbon is divided at the ink used up portion of the ink ribbon. In other words, wrinkles occur at the ink ribbon because the ink ribbon tension force distribution changes rapidly in the width direction of the ink ribbon. The ink ribbon wrinkles occur frequently at the line or boundary between an ink ribbon tension force flowing portion and a no tension force portion.

The generation of the ink ribbon wrinkles, which occurs by the "ink ribbon shifting down" phenomenon, will be explained with reference to FIGS. 1 and 2.

FIG. 1 is a side view taken from the back portion of the thermal head 103. It shows schematically the state where the thermal head 103 moves to the right (the direction of the arrow beneath the thermal head 103) when printing is being performed at the upper row 108 of the ink ribbon 112. The ink ribbon 112 has a width R. The diagonal lines indicate an unused portion of the ink ribbon 112, and the white portion of the ink ribbon 112 indicates the used up portion or the left out portion after the transfer printing operation on the thermal transfer printing paper.

The tension force distribution acting on the ink ribbon 112 of the above structure is shown in FIG. 2 in which lower row 110 dot printing is performed by using the thermal head 103. Such printing, for example a special mesh pattern printing, easily causes ink ribbon wrinkles to occur.

In the ink ribbon 112 being pressed by the thermal head 103, the taking up tension force ($T_o$) balances the back tension force ($T_i$) and the ink ribbon friction braking force ($T_H$) according to the pressing force of the thermal head 103. The taking up tension force ($T_o$) is divided into two tension forces which are the lower tension force ($T_{o1}$) and the upper tension force ($T_{o2}$). The upper tension force ($T_{o2}$) balances with the ink ribbon friction brake force ($T_H$).

At the used up portion (A) of the ink ribbon 112, the ink of the ink ribbon 112 is omitted and the thickness of the ink ribbon 112 is reduced from about 6 μm to about 3 μm. Further, by the heating of the thermal head 103, the taking up tension force ($T_o$) is divided into the upper portion tension force ($T_{o2}$) and the lower portion tension force ($T_{o1}$) with the used up portion (A) acting as the boundary portion. As the lower tension force ($T_{o1}$) is divided from the used up portion (A), the lower tension force ($T_{o1}$) flows through the lower side of the thermal head portion and balances with the back tension force ($T_i$).

As a result, the ink ribbon tension force becomes nearly zero at a region (So) of the ink ribbon 112 on the upstream side of the thermal head 103. Owing to the foregoing ink ribbon wrinkles occur easily at a boundary line portion (K) because the flow of the tension force in the ink ribbon 112 changes rapidly.

SUMMARY OF THE INVENTION

An object of the present invention is to provide an ink ribbon cassette for use in a thermal transfer printer wherein an align arrangement winding state of an ink ribbon for accomplishment of a reciprocating ink ribbon cassette can be attained.

Another object of the present invention is to provide an ink ribbon cassette for use in a thermal transfer printer wherein a stable tension force in the ink ribbon for accomplishment of a reciprocating ink ribbon cassette can be obtained.

A further object of the present invention is to provide an ink ribbon cassette for use in a thermal transfer printer wherein a tension force in the ink ribbon for accomplishment of a reciprocating ink ribbon cassette can be made uniform at the width direction of the ink ribbon.

A still further object of the present invention is to provide an ink ribbon cassette for use in a thermal transfer printer wherein the slack of the ink ribbon for accomplishment of a reciprocating ink ribbon cassette can be prevented therein.

A further object of the present invention is to provide an ink ribbon cassette for use in a thermal transfer printer wherein a tension force ratio range of the ink ribbon for accomplishment of a reciprocating ink ribbon cassette can be made larger.

In accordance with the present invention in combination with an ink ribbon cassette for use in a thermal transfer printer, the thermal transfer printer comprises a thermal head, a platen being pressed against the thermal head through a thermal transfer printing paper, an ink ribbon cassette receiving an ink ribbon having plural rows, a carriage mounted with the thermal head and the ink ribbon cassette and transversely moving along the platen, and the ink ribbon cassette comprises an ink ribbon cassette case, the ink ribbon being received in the ink ribbon cassette case, a supply core for supplying the ink ribbon, a taking up core to take up the ink ribbon, and an ink ribbon cassette cover.

Meandering guide means for guiding the ink ribbon are provided within the ink ribbon cassette and at a front side of a travelling direction of the thermal head so as to make tension force of the ink ribbon uniform at a width direction of the ink ribbon, whereby the ink ribbon shifting down phenomenon is reduced at the vicinity of the thermal head. The meandering guide means in the disclosed embodiment are formed by six guide rollers.

A plurality of guide means for curving or bending the ink ribbon are provided within the ink ribbon cassette, and the plurality of guide means are provided to be symmetric with respect to a center of the thermal head. The plurality of guide means comprise a first guide means provided in a vicinity of the thermal head, a second guide means provided in a vicinity of the supply core, a third guide means provided in a vicinity of the take up core, and a fourth guide means for curving or bending the ink ribbon provided between the first guide means and the second guide means. The third guide means, and the fourth guide means are disposed nearly in a vicinity of the first guide means so as to make tension force of the ink ribbon uniform at a width direction of the ink ribbon. Thereby the ink ribbon shifting down phenomenon is reduced at the vicinity of the thermal head.

In accordance with the present invention, the guide rollers or the guide posts are provided at the positions in which the tension force distribution changes rapidly. In other words, the guide rollers are provided at the vicinity of the thermal head so as to change the tension force distribution. The guide rollers provide restraint against the ink ribbon and lessen the region having no tension force by utilizing the friction force. The number or the position of the guide rollers is set suitably.

According to the present invention, the guide rollers or the guide posts are provided in the ink ribbon cassette and in the vicinity of the thermal head, and further a most suitable back tension force is give by an outer peripheral brake adding member and a supply side shaft brake adding member.

The guide rollers or the guide posts for curving or bending the ink ribbon are provided at the vicinity of the thermal head. By the provision of the guide rollers, the "ink ribbon shifting down" phenomenon in the thermal transfer printer can be improved or reduced drastically and the ink ribbon tension force ratio can be set substantially constant. Therefore, the rubbing transfer such as the "background dirty" phenomenon by the tail dragging or the "background dirty" by head touch smudge in the thermal transfer printer can be improved or reduced drastically.

The guide rollers or the guide posts for preventing the ink ribbon shifting down phenomenon allow the ink ribbon to curve or bend at the vicinity of the thermal head. Before the ink ribbon flows toward the thermal head direction, the ink ribbon tension force is made uniform at the width direction of the ink ribbon, so that the disadvantage of the ink ribbon wrinkles caused by the ink ribbon shifting down phenomenon does not occur therein.

The outer peripheral portion of the ink ribbon supply side is pressed at the ink ribbon supply by the outer peripheral brake adding member in which a plate spring member is attached to a friction member such as a felt member. However, as for only the outer peripheral brake adding member, by the bending reduction of the plate spring member, the ink ribbon brake force lessens in the proportion to the ink ribbon outer diameter which gets smaller.

This is caused by the difference between the pressing force of the ink ribbon minimum outer diameter and the pressing force of the ink ribbon maximum outer diameter. Therefore, it is necessary to provide the fixed brake adding member at the sending out core portion side so as to give a certain measure of the ink ribbon brake force at the ink ribbon take up side.

By the provision of the above stated two countermeasures in the present invention, the ink ribbon is given a stable back tension force from between the ink ribbon winding start to the ink ribbon winding completion. In other words, the ink ribbon tension force ratio is maintained substantially at a constant from the ink ribbon winding start to the ink ribbon winding completion.

In accordance with the present invention, the "ink ribbon shifting down" phenomenon can be prevented and thereby the ink ribbon tension force ratio can be made larger. Therefore, the "background dirty" phenomenon and the rubbing transfer phenomenon can be reduced, and a thermal transfer printer having high printing quality can be obtained.

The thermal transfer printer structure having a reciprocating ink ribbon cassette can be attained without a design change in the conventional uni-direction printing structure. The align arrangement winding state of the ink ribbon for accomplishment of the reciprocating ink ribbon cassette can be attained, thereby the bad ink ribbon winding accident can be prevented. The ink ribbon winding tension force can be set smaller and the size of the carriage etc. can be made smaller.

DESCRIPTION OF THE EMBODIMENT

An ink ribbon cassette for use in a thermal transfer printer according to one embodiment of the present invention will be explained with reference to FIGS. 3, 4, 5 and 6.

Figure 4:
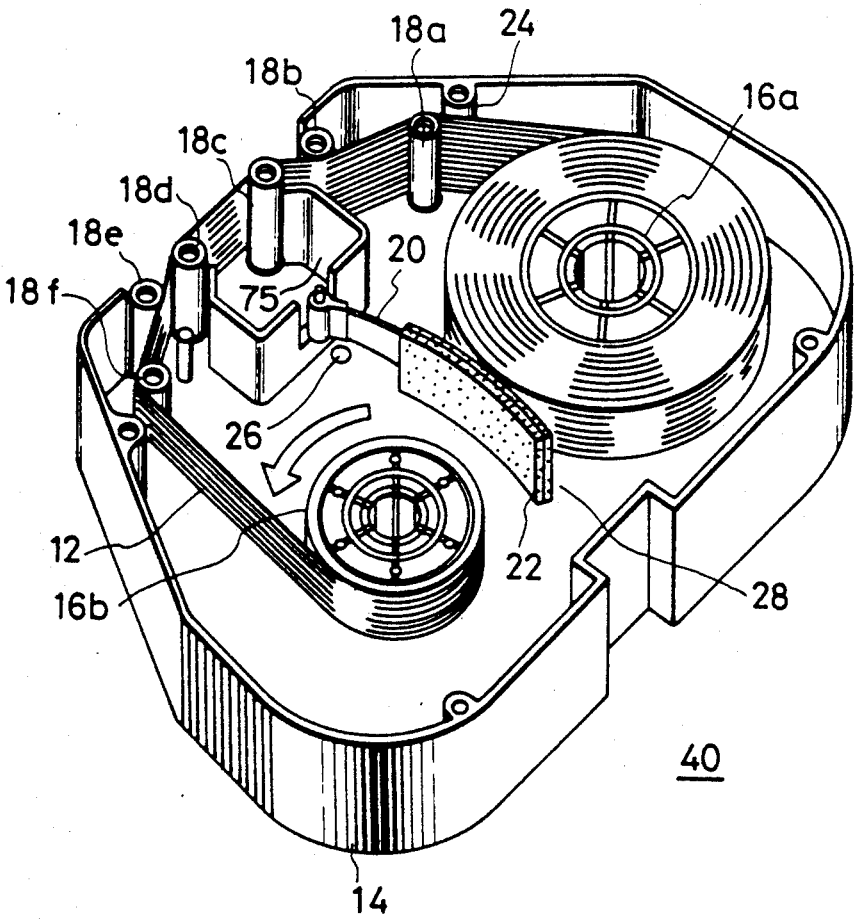
FIG. 4 is a perspective view of an ink ribbon cassette interior structure receiving an ink ribbon therein according to one embodiment of the present invention.

As shown in FIG. 4, an ink ribbon 12 having an upper row and a lower row is received in an ink ribbon cassette case 14. The ink ribbon 12 having about 50 mm diameter at the maximum diameter is wound on a supply core 16*a* mounted on the ink ribbon cassette case 14. The ink ribbon 12 is curved or bent among a plurality of portions or intervals from a guide roller 18*a* to a guide roller 18*f*.

More specifically, six guide rollers or six guide posts 18*a*–18*f* for curving or bending the ink ribbon 12 are provided within the ink ribbon cassette 40. The six guide rollers 18*a*–18*f* are provided symmetrically with respect to a center of the thermal head 3. The six guide rollers 18*a*–18*f* comprise two guide rollers 18*c* and 18*d* provided in a vicinity of the thermal head 3, a guide roller 18*a* provided in a vicinity of the supply core 16*a*, a guide roller 18*f* provided in a vicinity of the take up core 16*b*, and two guide rollers 18*b* and 18*e* for curving slightly the ink ribbon 12 provided respectively between the two guide rollers 18*c* and 18*a* and the guide roller 18*d* and the guide roller 18*f*.

The two guide rollers 18*b* and 18*e* are disposed respectively nearly in a vicinity of the two guide rollers 18*c* and 18*d* so as to make tension force of the ink ribbon 12 uniform in a width direction of the ink ribbon 12, thereby reducing the ink ribbon shifting down phenomenon at the vicinity of the thermal head 3.

The two guide rollers 18*c* and 18*d* and the two guide rollers 18*b* and 18*e* are disposed respectively at a center of the thermal head 3 and within a circle whose radius is about 15 mm from the center of the thermal head 3.

Figure 6:
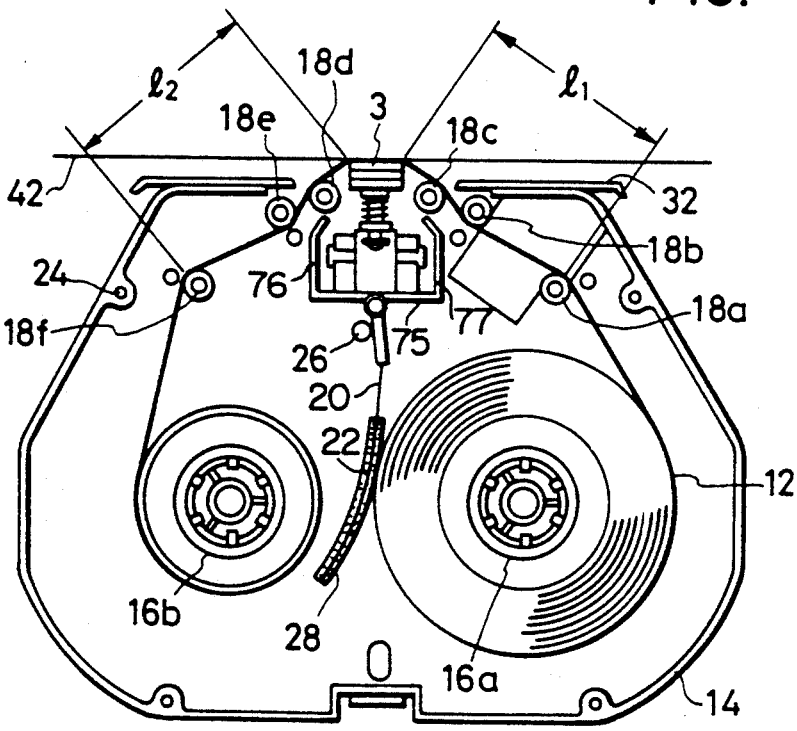
FIG. 6 is a plan view showing the ink ribbon curvature state in the ink ribbon cassette.

The tip of the ink ribbon 12 is attached to a take up side core 16*b* by adhesion thereof. A plate spring member 20 mounted on a U-shaped thermal head holding case 75 has a friction member such as a felt member 22 adhered at the outer surface thereof. The case 75 has two side walls 76, 77 whose free ends, shown in FIG. 6, are bent toward one another and are disposed behind the two guide rollers 18*d*, 18*c*, respectively. The pressing force is provided over the whole ink ribbon 12, which is wound on the supply core 16*a*, by contact between the surface of the felt member 22 and the surface of the ink ribbon 12.

The pressing force is provided by an outer peripheral brake adding member 28. The brake force occurs when a projection pin 30, which is provided at a carriage cover 32 mounted on a printer carriage 38 touches the plate spring member 20 side through a hole 26. The hole 26 is provided on the ink ribbon cassette case 14. A position determining hole 24 is provided on the ink ribbon cassette case 14 so as to join an ink ribbon cassette cover 34 therewith.

The back tension force adding members comprise a fixed brake adding member 70 provided at the supply shaft with which the supply core 16*a* is engaged, and the outer peripheral brake adding member 28 for contacting the ink ribbon 12. The outer peripheral brake adding member 28 comprises the plate spring member 20 and the felt member 22 attached to an outer surface of the plate spring member 20. The outer peripheral brake adding member 28 is provided within the ink ribbon cassette case 40 and contacts an outer surface of the ink ribbon 12 mounted on the supply core 16*a* through the felt member 22, thereby making the ink ribbon tension force ratio larger.

Figure 3:
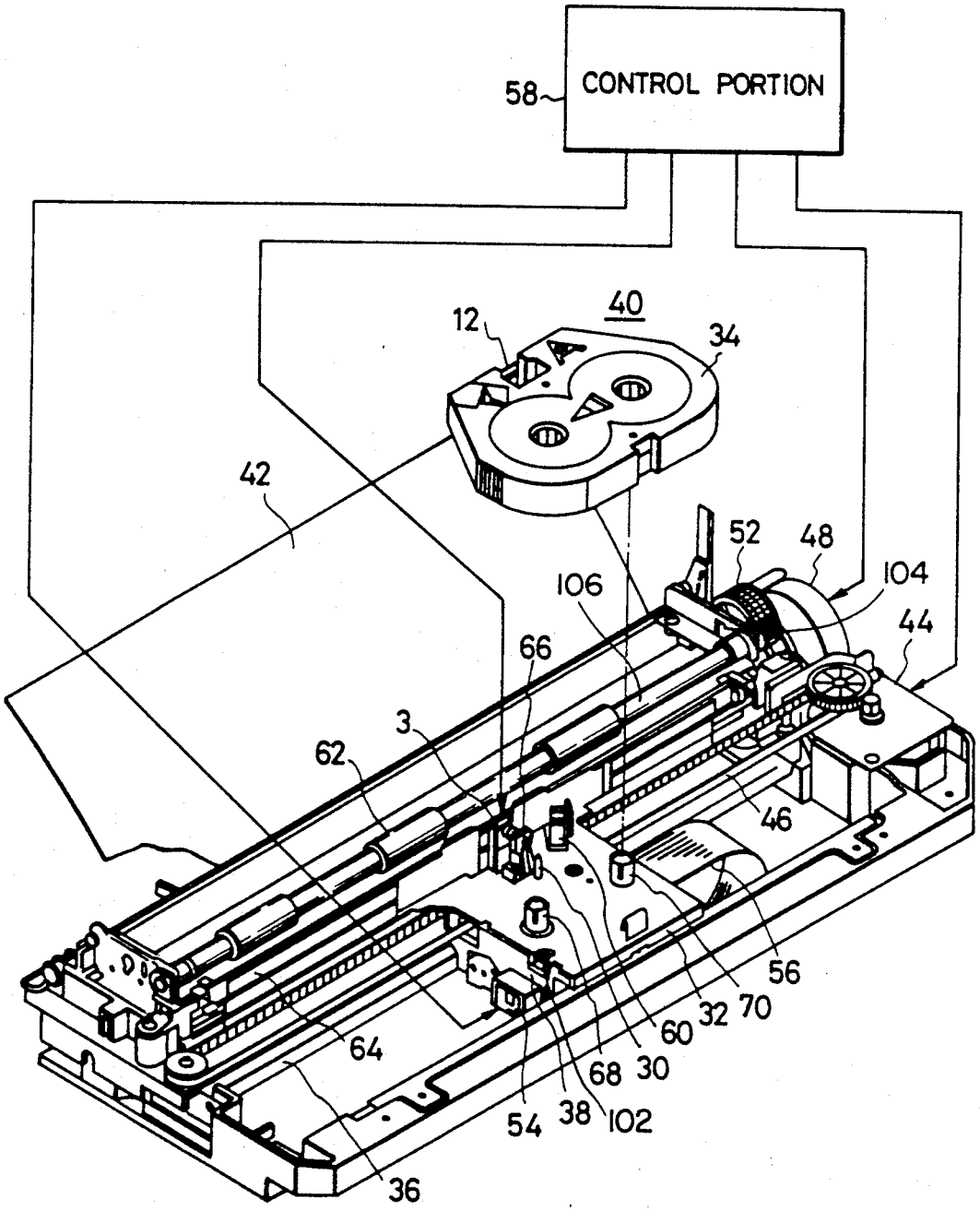
FIG. 3 is a perspective view of a thermal printer having an improved ink ribbon cassette according to one embodiment of the present invention.

As shown in FIG. 3, the thermal transfer printer includes a shaft 36 with a carriage 38 being slidingly disposed on the shaft 36. The carriage cover 32 is fixed to the carriage 38 by screws 102. The ink ribbon cassette 40 is mounted on the carriage cover 32. A thermal head 3 is mounted on the carriage 38, and the ink ribbon 12 is received within the ink ribbon cassette 40. When heat is applied to thermal head 3, ink on the ink ribbon 12 is transferred to a thermal transfer printing paper 42.

The carriage 38 can move in the rightward direction and the leftward direction by a carriage motor 44 through a timing belt 46. The thermal transfer printing paper 42 is advanced toward the front side of the thermal head 3 with driving power being transmitted to a gear 52 which is meshed with a smaller gear 104 fixed on a roller shaft 106 supporting thermal transfer printing paper feed roller 62 for rotating the roller 62.

A home position sensor 54 determines the position of the printing start when the carriage 38 moves in the rightward direction relative to the printer main body. A flat cable member 56 is employed to supply current to the thermal head 3 and other circuitry.

The thermal transfer printer of this embodiment of the present invention is made in the manner that printing is performed when the carriage 38 is moving from the leftward direction to the rightward direction, i.e. a unidirectional printing method. The ink ribbon 12 is wound when the carriage 38 moves in the rightward direction, and the ink ribbon 12 is not wound when the carriage 38 moves in the leftward direction.

A controlling portion apparatus 58 controls the carriage motor 44, the line feed motor 48, the home position sensor 54, the thermal head 3, an ink ribbon detection sensor 60 for detecting the black ink of the ink ribbon 12 and the like.

After the thermal transfer printing paper 42 is printed between a platen 64, the ink ribbon 12 and the thermal head 3, the thermal transfer printing paper feed roller 62 feeds the thermal transfer printing paper 42. A pressing spring member 66 presses the ink ribbon 12 and the thermal transfer printing paper 42 between the platen 64 and the thermal head 3, and thereby provides high quality thermal transfer printing.

During the printing operation a take up shaft 68 takes up the ink ribbon 12 during the carriage movement from the leftward direction to the rightward direction. The supply shaft brake adding member 70 provides a brake force to the supply core 16*a* in addition to the outer peripheral brake adding member 28. The source of the ink ribbon back tension force in this embodiment of the present invention is the above stated two brake adding members 28 and 70.

Figure 5:
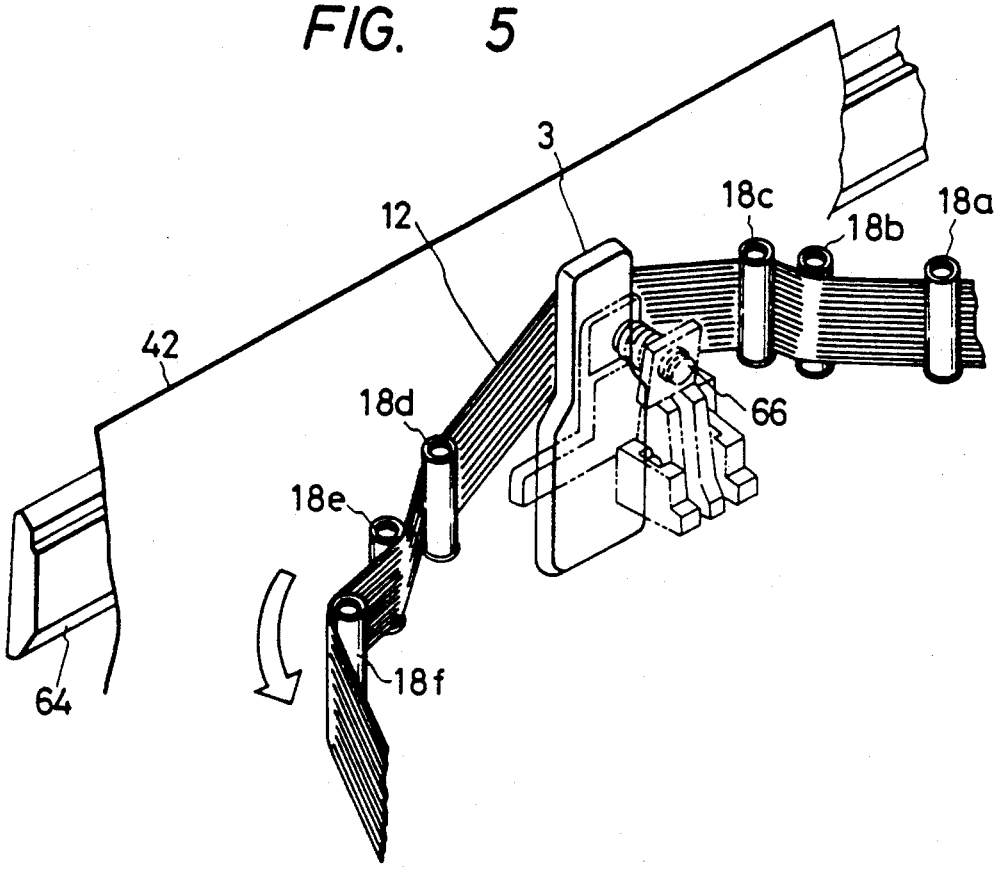
FIG. 5 is an isolated view showing the guide roller arrangement in the ink ribbon cassette in the vicinity of the thermal head.

The role of the guide rollers 18*a*–18*f* provided at the vicinity of the thermal head 3 during the head touch condition will be explained with reference to FIG. 5. In FIG. 5, the thermal transfer printing paper 42 is pressed to the platen 64 by the pressing spring member 66, and the thermal head 3 is supplied with electric current to generate the thermal energy.

The ink of the ink ribbon 12 is fused by the thermal energy supplied from the thermal head 3 and is transferred to the thermal transfer printing paper 42. At this time, the thickness of the ink ribbon 12 is reduced from about 7 μm to about 3–3.5 μm at the ink-used-up portion or at the ink omitted portion, and further ink ribbon local elongation occurs at the ink-used-up portion as a result of the heat, thereby creating an imbalance in the tension force in the ink ribbon 12.

However, in this embodiment of the present invention, for removal of the imbalance of the tension force in the ink ribbon 12, the guide roller 18*c* and the guide roller 18*d* are provided respectively in the vicinity of the thermal head 3, and further the guide roller 18*b* and the guide roller 18*e* are provided so as to curve or bend slightly the ink ribbon 12.

Figure 1:
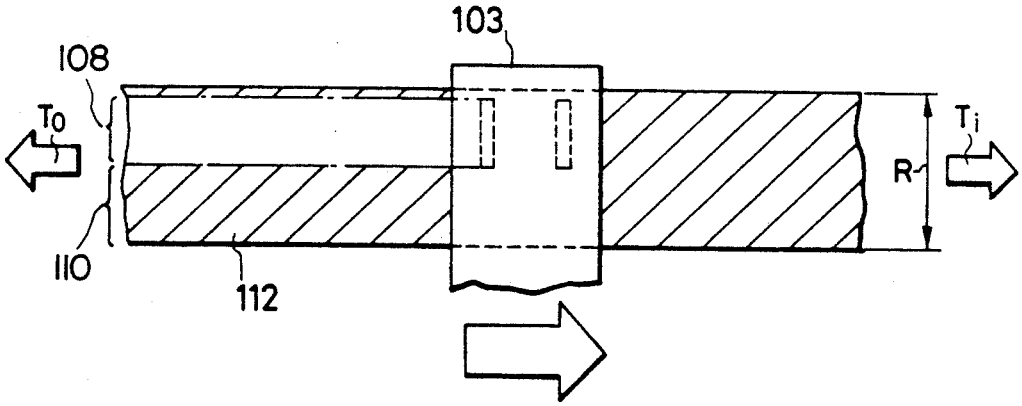
FIG. 1 is a view showing a relationship between a thermal head and an ink ribbon, as seen from behind a thermal head.
Figure 2:
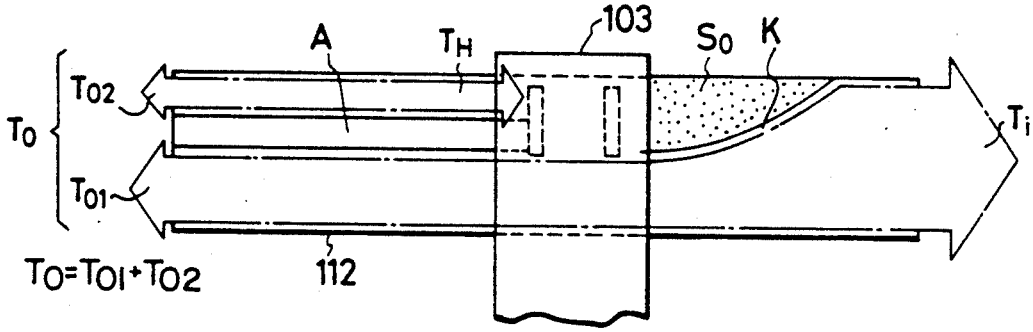
FIG. 2 explains various tension forces generated at the ink ribbon portion shown in FIG. 1.

By the provision of the above stated guide rollers 18*c*, 18*d*, 18*b* and 18*e*, the tension force flow in the ink ribbon 12 is varied at the portions in which the tension force distribution changes rapidly and the boundary line portion (K) and the region ($S_0$) shown in FIG. 2 are lessened respectively, so that the ink ribbon 12 is stretched straight and thereby no ink ribbon wrinkles occur therein.

FIG. 6 is a plan view showing the curvature of the ink ribbon 12 in the ink ribbon cassette interior. The ink ribbon 12 is pressed with the thermal transfer printing paper 42 by the thermal head 3 and, the ink ribbon 12 is curved or bent in the vicinity of the thermal head 3 from the guide roller 18*a* to the guide roller 18*f*, at a portion $l_1$ and a portion $l_2$, so that the ink ribbon 12 has no slack. Thereby, the ink ribbon 12 can be wound at the take up side core 16*b* in the aligned arrangement winding state.

If slack exists at the portions $l_1$ and $l_2$ of the ink ribbon 12, a head touch smudge occurs or the ink ribbon shifts down. The guide roller 18*b* and the guide roller 18*e* play respectively the important role for prevention of the ink ribbon wrinkles.

Figure 7:
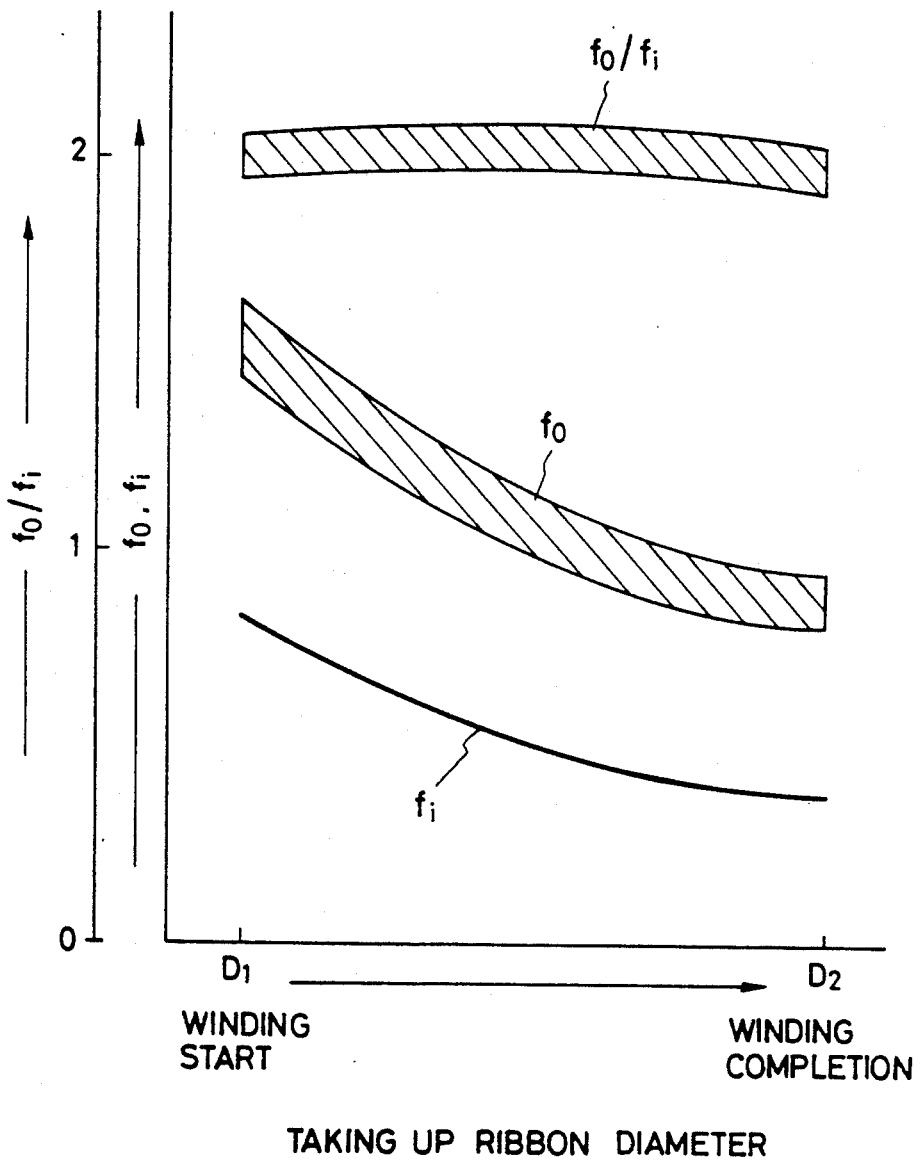
FIG. 7 is a graph showing a relationship between a taking up tension force ($f_o$) and a back tension force ($f_1$) and a tension force ratio ($f_o/f_1$).

The experimentation results of this embodiment of the present invention will be explained referring to FIG. 7. In FIG. 7, ($f_1$) indicates the back tension force and ($f_0$) indicates the take up tension force. The ratio of the take up tension force ($f_0$) and the back tension force ($f_1$) against the ink ribbon outer diameter is a constant substantially over the whole winding range from the ink ribbon winding start ($D_1$) to the ink ribbon winding completion ($D_2$).

In other words, since the ink ribbon tension force ratio ($f_0/f_1$) is a substantially constant value, the ideal ink ribbon tension force characteristics can be realized as the reciprocating ink ribbon cassette 40. The relationship between the taking up tension force ($f_0$) and the back tension force ($f_1$) is constant over the whole winding range, and thus there are no problems involving ink ribbon winding or a dirty background.

According to the embodiment of the present invention, shifting down of the ink ribbon can be prevented, and the ink ribbon tension force ratio can thereby be made larger. Therefore, the dirty background phenomenon and rubbing transfer can be reduced so that a thermal transfer printer structure having a reciprocating ink ribbon cassette 40 can be attained. An aligned arrangement winding of the ink ribbon 12 to make possible the reciprocating ink ribbon cassette 40 can now be attained, thereby preventing bad ink ribbon winding accidents. The ink ribbon winding tension force $f_0$ can be set smaller, and the size of the carriage 38 and the like can be made smaller.

We claim:

1. An ink ribbon cassette for use in a thermal transfer printer, said cassette having tension means and symmetrically located guide rollers, said thermal transfer printer comprising a thermal head, a platen pressed against said thermal head with a thermal transfer printing paper therebetween, a carriage mounted with said thermal head and said ink ribbon cassette and transversely movable along said platen, and said ink ribbon cassette further comprising an ink ribbon with plural rows, an ink ribbon cassette case, said ink ribbon being received in said ink ribbon cassette case, a supply core for supplying said ink ribbon, a take-up core for taking up said ink ribbon, and an ink ribbon cassette cover, wherein said guide rollers comprise six guide rollers for said ink ribbon provided with said ink ribbon cassette and symmetric with respect to a center of said thermal head, a first and second of said guide rollers being located in a vicinity of said thermal head, a third one of said guide rollers being located in a vicinity of said supply core, a fourth of said guide rollers being located in a vicinity of said take-up core, a fifth and sixth of said guide rollers being located between said first and second guide rollers and said third guide roller and said fourth guide roller, said fifth and sixth guide rollers being disposed in a vicinity of said first and second guide rollers, wherein the ink ribbon guiding structure in the immediate vicinity of said thermal head consists essentially of said fifth and sixth guide rollers and said first and second guide rollers which form a guide roller system for said ink ribbon, at a front side of a travelling direction of said thermal head so as to make a tension force of said ink ribbon uniform in a width direction of said ink ribbon, whereby a shifting down of said ink ribbon is reduced in the vicinity of said thermal head, and said tension means include back tension force adding members comprising a fixed brake adding member at a supply shaft on which said supply core is mounted and an outer peripheral brake adding member contacting said ink ribbon and provided within said ink ribbon cassette case, said outer peripheral brake adding member comprising a plate spring member and a felt member attached at an outer surface of said plate spring member, to contact at a line on an outer surface of said ink ribbon mounted on said supply core, whereby a contact position of said outer peripheral brake adding member continually changes at the point on the outer surface of said ink ribbon so that said outer peripheral brake adding member always contacts a new outer surface of said ink ribbon, thereby increasing an ink ribbon tension force ratio.

2. The ink ribbon cassette according to claim 1, wherein the cassette further includes a thermal head holding case having side walls disposed rearwardly of said first and second guide rollers as viewed in a direction from the front side toward the supply and take-up cores.

3. The ink ribbon cassette according to claim 2, wherein the side walls are substantially aligned with said first and second guide rollers as viewed in the direction from the front side.

4. The ink ribbon cassette according to claim 1, wherein a thermal head holding case is operatively associated with said outer peripheral brake adding member.

5. The ink ribbon cassette according to claim 4, wherein the cassette further includes a thermal head holding case having side walls disposed rearwardly of said first and second guide rollers as viewed in a direction from the front side toward the supply and take-up cores.

6. The ink ribbon cassette according to claim 5, wherein the side walls are substantially aligned with said first and second guide rollers as viewed in the direction from the front side.

* * * * *